US008976164B2

(12) United States Patent
Liang et al.

(10) Patent No.: US 8,976,164 B2
(45) Date of Patent: Mar. 10, 2015

(54) CIRCUIT FOR ELIMINATING SHUTDOWN AFTERIMAGES OF A DISPLAY DEVICE

(71) Applicants: BOE Technology Group Co., Ltd., Beijing (CN); Hefei BOE Optoelectronics Technology Co., Ltd., Hefei (CN)

(72) Inventors: Hengzhen Liang, Beijing (CN); Yuting Yang, Beijing (CN)

(73) Assignees: BOE Technology Group Co., Ltd., Beijing (CN); Hefei BOE Optoelectronics Technology Co., Ltd., Anhui (CN)

( * ) Notice: Subject to any disclaimer, the term of this patent is extended or adjusted under 35 U.S.C. 154(b) by 81 days.

(21) Appl. No.: 13/941,731

(22) Filed: Jul. 15, 2013

(65) Prior Publication Data

US 2014/0085289 A1 Mar. 27, 2014

(30) Foreign Application Priority Data

Sep. 21, 2012 (CN) ..... 2012 1 0357277

(51) Int. Cl.
*G09G 5/00* (2006.01)
*G09G 3/36* (2006.01)

(52) U.S. Cl.
CPC ..... *G09G 3/3611* (2013.01); *G09G 3/3696* (2013.01); *G09G 3/3648* (2013.01); *G09G 2320/0257* (2013.01); *G09G 2330/025* (2013.01); *G09G 2330/027* (2013.01)
USPC ..... 345/212; 345/214

(58) Field of Classification Search
CPC . G09G 3/3611; G09G 3/3648; G09G 3/3696; G09G 2320/0257; G09G 2330/025; G09G 2330/027
USPC ..... 345/92, 212, 214
See application file for complete search history.

(56) References Cited

U.S. PATENT DOCUMENTS

| | | | | |
|---|---|---|---|---|
| 5,343,221 | A * | 8/1994 | Arakawa et al. | 345/211 |
| 2002/0195965 | A1* | 12/2002 | Kawano | 315/169.3 |
| 2003/0020676 | A1* | 1/2003 | Lin et al. | 345/87 |
| 2013/0162618 | A1* | 6/2013 | Seo et al. | 345/212 |

* cited by examiner

*Primary Examiner* — Tom Sheng

(57) ABSTRACT

The invention relates to a field of display technique. There is disclosed a circuit for eliminating shutdown afterimages of a display. By designing a circuit capable of generating voltages for tuning on TFTs in a time-division way, it is realized that when the display screen shuts down, not only the significant discontinuous differences of pictures are ensured to be not perceived by human eyes so as to eliminate the shutdown afterimages, but also such a problem can be avoided that the circuitry in the panel is burned out by the overlarge instantaneous current caused by the simultaneous turning on of all the TFTs at the moment of shutdown.

16 Claims, 6 Drawing Sheets

(a)

(b)

CIRCUIT FOR ELIMINATING SHUTDOWN AFTERIMAGES OF A DISPLAY DEVICE

CROSS REFERENCE TO RELATED APPLICATIONS

This application claims priority from Chinese National Application No. 201210357277.0, filed on Sep. 21, 2012, the contents of which are incorporated herein by reference.

FIELD OF THE INVENTION

The present disclosure relates to a field of display technique, and in particular, to a circuit for eliminating shutdown afterimages of a display.

BACKGROUND

In order to solve such a problem of the shutdown afterimages, nowadays there has been used in TFT-LCDs a function for turning on all of the TFTs at the moment of shutdown, that is, a function of XON (may be deemed as a control signal for turning on all the TFTs in all rows at the time of shutdown).

When the XON function acts, a scan line driving IC may output a voltage VGH (a turn-on voltage of the TFT) to turn on all the TFTs, and the higher the VGH is, the larger an instantaneous current generated at the TFT is. In a process for pressure welding the scan line driving IC on the TFT-LCD panel through a ACF glue (an anisotropic conductive glue), some gold particles in the ACF glue (being conductive) contact well, but others contact badly after signal lines between the scan line driving IC and the TFT-LCD panel are turned on. In a case of less gold particles, the current flowing through the gold particles which contact well is large. When the display shuts down, the current flowing through the gold particles which contact well is large since the instantaneous current on the TFT is large. When the current exceeds an endurance capacity of the gold particles, a part of the gold particles would be fused, and thus other gold particles have to bear these instantaneous currents. After starting up and shutting down repetitiously the display several times, all the gold particles would be fused at last, and finally the TFTs cannot be turned on, which would render an abnormal display of pictures. In this case, it would be required in the process for pressure welding the scan line driving IC on the TFT-LCD panel that the number of the gold particles is more enough, and a homogeneity requirement for the gold particles is also very high, otherwise it is terribly easy for the gold particles to be fused that results in the phenomenon of abnormal display of pictures. This problem is especially serious in displays with a high resolution and a large size.

SUMMARY OF THE INVENTION

A technical problem to be solved by the invention is how to avoid such a problem that a circuitry in a panel is burned out due to an overlarge current at the moment of shutdown while the shutdown afterimages of the display are ensured to be eliminated.

To solve the above technical problems, the present disclosure provides a circuit for eliminating shutdown afterimages of a display, including a plurality of stages of time division circuits, the time division circuit in each stage comprises: a comparator, a MOS transistor, a first resistor, a second resistor, a third resistor and a capacitor, wherein a first terminal of the first resister serves as a first input terminal of the time division circuit of the stage, and a second terminal thereof serves as an output terminal of the time division circuit of the stage; a first terminal of the second resistor is connected with a second terminal of the third resistor, a second terminal of the second resistor serves as a second input terminal of the time division circuit of the stage, and a first terminal of the third resistor is grounded; an non-inverting terminal or an inverting terminal of the comparator is connected with a second terminal of the capacitor and the second terminal of the third resistor, the inverting terminal or the non-inverting terminal of the comparator is connected with a reference voltage of the time division circuit of the stage, an output terminal of the comparator is connected with a gate of the MOS transistor, a drain of the MOS transistor is connected with the second terminal of the first resistor; a first terminal of the capacitor is grounded; and the inverting terminals of the comparators of the time division circuits in each stage are connected with each other, the non-inverting terminals are also connected with each other, and the first input terminals of the time division circuits in each stage are shared, the second input terminals of the time division circuits in each stage are also shared.

Preferably, for the time division circuit in each stage, the non-inverting terminal of the comparator is connected with the second terminal of the capacitor and the second terminal of the third resistor when the MOS transistor is a P-type MOSFET transistor; and the inverting terminal of the comparator is connected with the second terminal of the capacitor and the second terminal of the third resistor when the MOS transistor is a N-type MOSFET transistor.

Preferably, for the time division circuit in each stage, a fixed preset voltage is input to the first input terminal, and voltages being varied from high to low are input to the second input terminal.

Preferably, the second resistor and the third resistor satisfy the following relation:

$$R3_i/(R2_i+R3_i)*V_i=V\mathrm{REF}$$

wherein $R2_i$ represents the second resistor of the time division circuit of the $i^{th}$ stage, $R3_i$ represents the third resistor of the time division circuit of the $i^{th}$ stage, VREF represents the reference voltage of the time division circuit of the $i^{th}$ stage, $V_i$ is a preset value, and the i is a positive integer and greater than 1.

Preferably, when there are two stages of the time division circuits, the $V_1$ is 4.0V, the $V_2$ is 3.7V, and a voltage inputted to the first input terminal is 3.3V.

Preferably, a voltage at the second input terminal satisfies the following condition:

$$V\mathrm{IN}>Vi>V(i-1)>\ldots>V1>V\mathrm{REF}$$

wherein VIN represents the voltage at the second input terminal, VREF represents the reference voltage of the time division circuit of the $i^{th}$ stage, Vi represents a voltage at a node between the second resistor and the third resistor of the time division circuit of the $i^{th}$ stage, i is a positive integer and greater than 1.

Preferably, a delay time Δt for outputting a high level from the output terminal XONi of the time division circuit of the $i^{th}$ stage with respect to the output terminal XON(i−1) of the time division circuit of the $(i-1)^{th}$ stage satisfies three conditions as follows simultaneously:

I. Δt is less than a period of time when VIN remains higher than the voltage at the first input terminal after XON(i−1) outputs the high level;

II. Δt is more than duration of an instantaneous current generated when a display shuts down for the first time; and III. Δt<33.3 ms;

wherein VIN represents the voltage at the second input terminal.

Preferably, 100 μs<Δt<5 ms.

Preferably, for each stage of the time division circuits, both of a source and a substrate of the MOSFET transistor are grounded.

The above solutions have following advantages: by designing a circuit capable of generating voltages for turning on TFTs in a time-division way, it is realized that when the display screen shuts down, not only the significant discontinuous differences of pictures are ensured to be not perceived by human eyes so as to eliminate the shutdown afterimages, but also such a problem that the circuitry in the panel is burned out by the overlarge instantaneous current caused by the simultaneous turning on of all the TFTs at the moment of shutdown can be avoided.

Furthermore, the time division circuit designed in the present disclosure may be utilized to realize an area-division control for the display screen panel.

DETAILED DESCRIPTION

Figure 1:
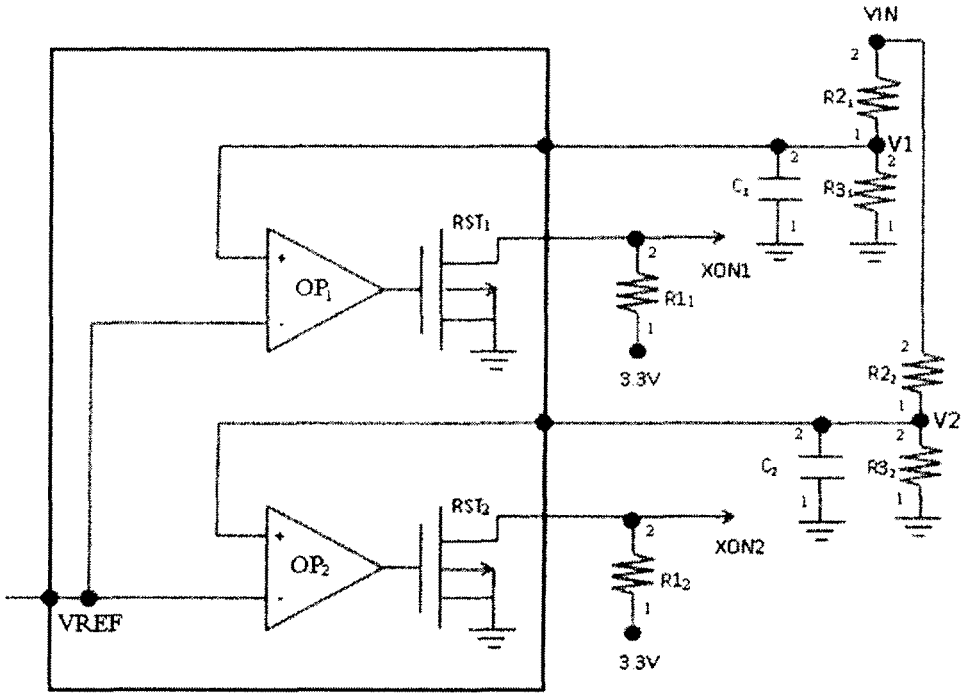
FIG. 1 is a circuit diagram illustrating a first embodiment of the invention.

Thereafter, specific implementations of the present disclosure will be further described in detail in connection with the drawings and the embodiments. The following embodiments are only used to explain the principle of the invention, but not to limit a scope of the invention.

The present disclosure provides a circuit for eliminating shutdown afterimages of a display, including a plurality of stages of time division circuits, each stage of the time division circuits comprises: a comparator, a MOS transistor, a first resistor, a second resistor, a third resistor and a capacitor, wherein a first terminal of the first resister serves as a first input terminal of the time division circuit of the stage, and a second terminal of the first resister serves as an output terminal of the time division circuit of the stage; a first terminal of the second resistor is connected with a second terminal of the third resistor, a second terminal of the second resistor serves as a second input terminal of the time division circuit of the stage, and a first terminal of the third resistor is grounded; non-inverting terminal or an inverting terminal of the comparator is connected with a second terminal of the capacitor and the second terminal of the third resistor, the inverting terminal or the non-inverting terminal of the comparator is connected with a reference voltage of the time division circuit of the stage, an output terminal of the comparator is connected with a gate of the MOS transistor, a drain of the MOS transistor is connected with the second terminal of the first resistor; a first terminal of the capacitor is grounded; and the inverting terminals of the comparators of the time division circuits in each stage are connected with each other, the non-inverting terminals are also connected with each other, and the first input terminals of the time division circuits of each stage are shared, the second input terminals of the time division circuits of each stage are also shared. For the time division circuit of each stage, both of a source and a substrate of the MOSFET transistor are grounded.

For the time division circuit in each stage, the non-inverting terminal of the comparator is connected with the second terminal of the capacitor and the second terminal of the third resistor when the MOS transistor is a P-type MOSFET transistor; and the inverting terminal of the comparator is connected with the second terminal of the capacitor and the second terminal of the third resistor when the MOS transistor is a N-type MOSFET transistor. A fixed preset voltage is input to the first input terminal, and voltages being varied from high to low are input to the second input terminal. Further, the second resistor and the third resistor satisfy the following relation:

$$R3_i/(R2_i+R3_i)*V_i=VREF$$

wherein $R2_i$ represents the second resistor of the time division circuit of the $i^{th}$ stage, $R3_i$ represents the third resistor of the time division circuit of the $i^{th}$ stage, the VREF represents the reference voltage of the time division circuit of the $i^{th}$ stage, and $V_i$ is a preset value, and i is a positive integer and greater than 1.

A circuit structure and an operation principle for eliminating the shutdown afterimages of a display according to the present disclosure will be described below, by taking two stages of the time division circuits as an example. Those skilled in the art may extend the circuit structure of the present disclosure to three or more stages according to following embodiments, since their operation principles are similar.

First Embodiment

As illustrated in FIG. 1, the embodiment provides a circuit for eliminating the shutdown afterimages of a display, including two stages of the time division circuits.

Figure 2:
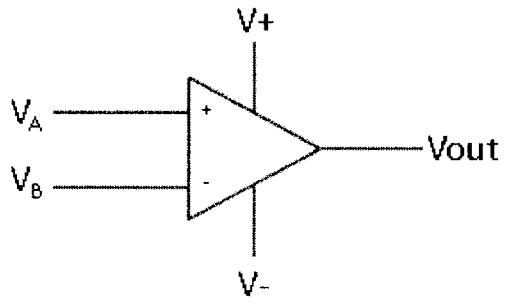
FIG. 2 is a schematic view illustrating respective terminals of a comparator.
Figure 3:
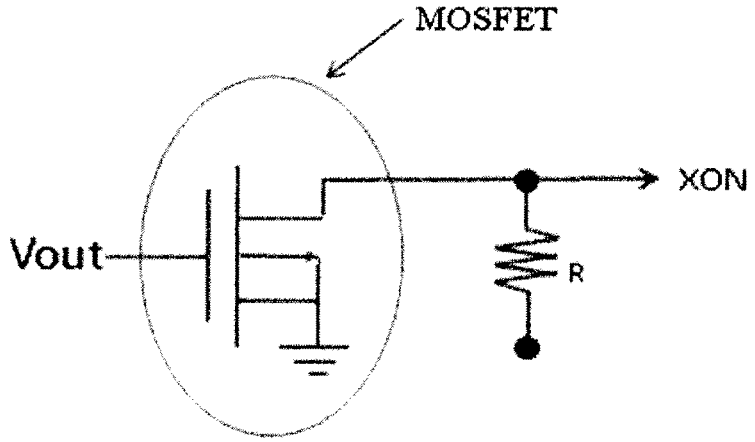
FIG. 3 is a schematic view illustrating respective terminals of a MOSFET transistor.

The time division circuit of the first stage comprises: a comparator $OP_1$, a P-type MOSFET transistor $RST_1$, a first resistor $R1_1$, a second resistor $R2_1$, a third resistor $R3_1$ and a capacitor $C_1$, wherein a first terminal of the first resistor $R1_1$ serves as a first input terminal of the time division circuit of the stage and its input voltage is 3.3V, and a second terminal thereof serves as an output terminal XON1 of the time division circuit of the stage; a first terminal of the second resistor $R2_1$ is connected with a second terminal of the third resistor $R3_1$, a second terminal of the second resistor $R2_1$ serves as a second input terminal VIN of the time division circuit of the stage, and a first terminal of the third resistor $R3_1$ is grounded; an non-inverting terminal of the comparator $OP_1$ is connected with a second terminal of the capacitor $C_1$ and the second terminal of the third resistor $R3_1$, an inverting terminal of the comparator $OP_1$ is connected with a reference voltage VREF of the time division circuit of the stage, an output terminal of the comparator $OP_1$ is connected with a gate of the transistor $RST_1$; a first terminal of the capacitor $C_1$ is grounded; a drain of the transistor $RST_1$ is connected with the second terminal of the first resistor $R1_1$, and both of a source and a substrate thereof are grounded. As illustrated in FIG. 2, when a voltage at the non-inverting terminal of the comparator is greater than that at the inverting terminal thereof, the comparator outputs a high level, and when the voltage at the inverting terminal of the comparator is greater than that at the inverting terminal thereof, the comparator outputs a low level. As illustrated in FIG. 3, the P-type MOSFET transistor is turned off when its gate is at the high level, then its drain outputs the high level (for example, 3.3V), while the P-type MOSFET transistor is turned on when its gate is at the low level, and then its drain outputs the low level (for example, 0V).

The second stage of the time division circuit comprises: a comparator $OP_2$, a P-type MOSFET transistor $RST_2$, a first resistor $R1_2$, a second resistor $R2_2$, a third resistor $R3_2$ and a capacitor $C_2$, wherein a first terminal of the first resistor $R1_2$ serves as a first input terminal of the time division circuit of the stage and its input voltage is 3.3V, and a second terminal thereof serves as an output terminal XON2 of the time division circuit of the stage; a first terminal of the second resistor $R2_2$ is connected with a second terminal of the third resistor $R3_2$, a second terminal of the second resistor $R2_2$ serves as a second input terminal VIN of the time division circuit of the stage, and a first terminal of the third resistor $R3_2$ is grounded; an non-inverting terminal of the comparator $OP_2$ is connected with a second terminal of the capacitor $C_2$ and the second terminal of the third resistor $R3_2$, a first terminal of the capacitor $C_2$ is grounded; an inverting terminal of the comparator $OP_2$ is connected with a reference voltage VREF of the time division circuit of the stage, an output terminal of the comparator $OP_2$ is connected with a gate of the transistor $RST_2$; a drain of the transistor $RST_2$ is connected with the second terminal of the first resistor $R1_2$, and both of a source and a substrate thereof are grounded.

The inverting terminal of the comparator $OP_1$ of the time division circuit of the first stage and the inverting terminal of the comparator $OP_2$ of the time division circuit of the second stage are connected with each other, their non-inverting terminals are also connected with each other. The first input terminals are shared, the second input terminals VIN are also shared, and voltages varied from high to low are input to the second input terminal.

Figure 4:
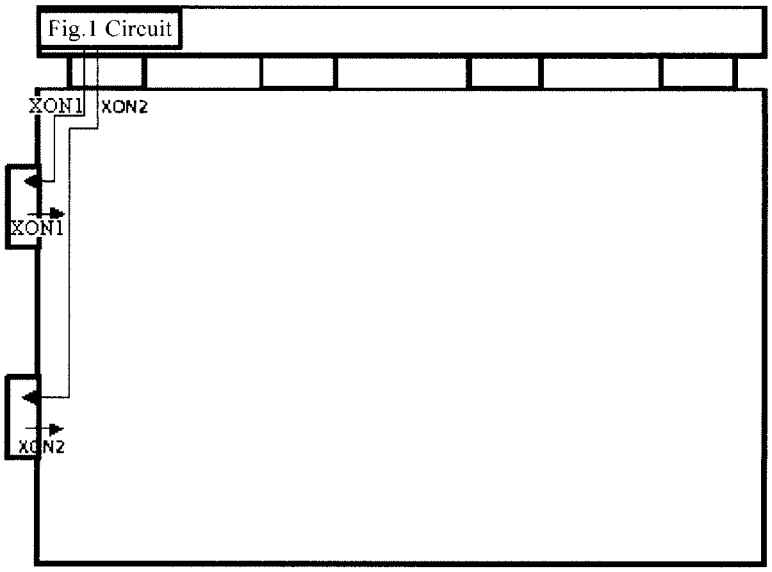
FIG. 4 is a schematic view illustrating a case where TFTs in a panel are controlled to be turned on in the area-division mode by means of the principle of the invention.
Figure 4:
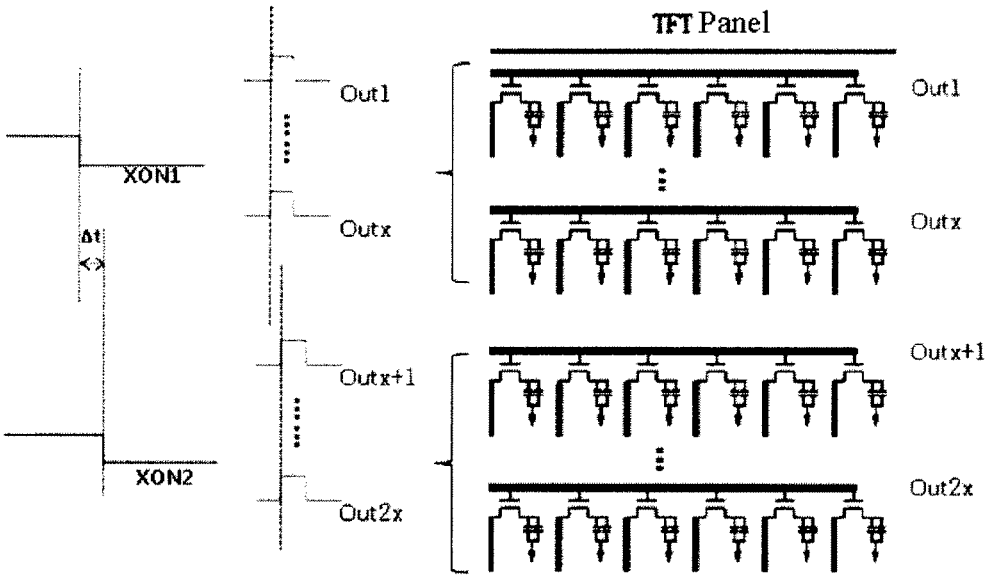

As illustrated in FIG. 4, when the circuit of the embodiment is used, the output terminals XON1 and XON2 are connected to different TFTs on the liquid crystal display panel, respectively, so that different TFTs are used for the purpose of turning on at different moments when the display shuts down. Further, to enable the different TFTs to be turned on sequentially, a condition of VIN>V2>V1>VREF should be satisfied, as illustrated in FIG. 1 again.

1. When V1<VREF, XON1 outputs the high level, and when V2<VREF, XON2 outputs the high level.

2. V1 and V2 have been decreasing since VIN has been decreasing, and XON1 or XON2 would output the high level when V1 or V2 decreases to a value of VREF. If V1 decreases to VREF first, XON1 outputs the high level first; and if V2 decreases to VREF first, XON2 outputs the high level first thereby it is required that V1<V2. Assuming that V1=VREF when VIN decreases to, for example, 4.0V, XON1 outputs the high level; V2=VREF when VIN decreases to, for example, 3.7V, XON2 outputs the high level.

In order to avoid the problem that the circuitry in a panel is burned out due to an overlarge current at a moment of shutdown while the shutdown afterimages of a display is ensured to be eliminated, the delay time Δt for outputting the high level from XON2 with respect to XON1 is required to satisfy the following conditions:

I. VIN remains more than 3.3V when XON2 outputs the high level so as to ensure that other functions on the panel are normal, and therefore Δt needs to be less than a period of time during which VIN remains more than 3.3V after XON1 outputs the high level;

II. Δt needs to be more than duration of the instantaneous current generated when the display shuts down for the first time; and III. a value of Δt should ensure that human eyes can not perceive any significant discontinuous differences of pictures. Generally, for the liquid crystal display, Δt needs to be less than a period corresponding to 1/30 Hz, that is, Δt<33.3 ms.

After testing, the period when VIN remains more than 3.3V after XON1 outputs the high level is 5 ms, and the duration of the instantaneous current generated when the display shuts down for the first time is 100 μs, so that it is proposed that Δt satisfies 100 μs<Δt<5 ms.

In the present embodiment, the above requirement may be satisfied by setting resistance values of the second resister and the third resister (acting as divider resisters). In the present embodiment, the second resister and the third resister satisfy the following relations:

$$R3_1/(R2_1+R3_1)*4.0=VREF,$$

and $$R3_2/(R2_2+R3_2)*3.7=VREF;$$

wherein $R2_1$ and $R2_2$ represent the second resisters of the time division circuit of the first stage and the time division circuit of the second stage, respectively; $R3_1$ and $R3_2$ represent the third resisters of the time division circuit of the first stage and the time division circuit of the second stage, respectively; VREF represents the reference voltage of the time division circuit of the first stage and the time division circuit of the second stage.

Figure 6:
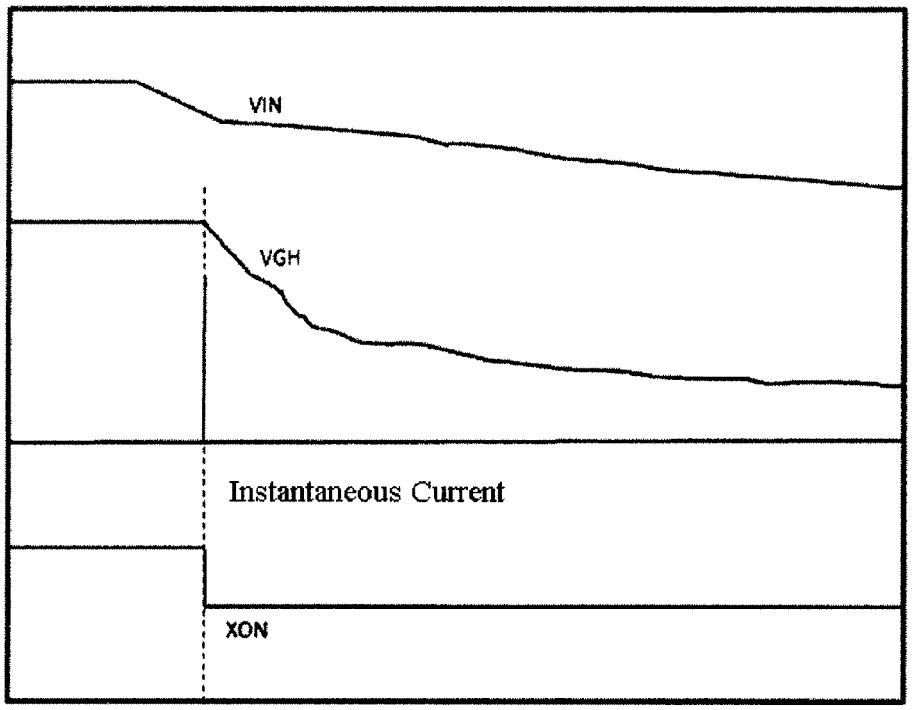
FIG. 6 is a waveform diagram illustrating an input voltage and an output voltage of a circuit for eliminating shutdown afterimages of a display without the time division control in the prior art.
Figure 7A:
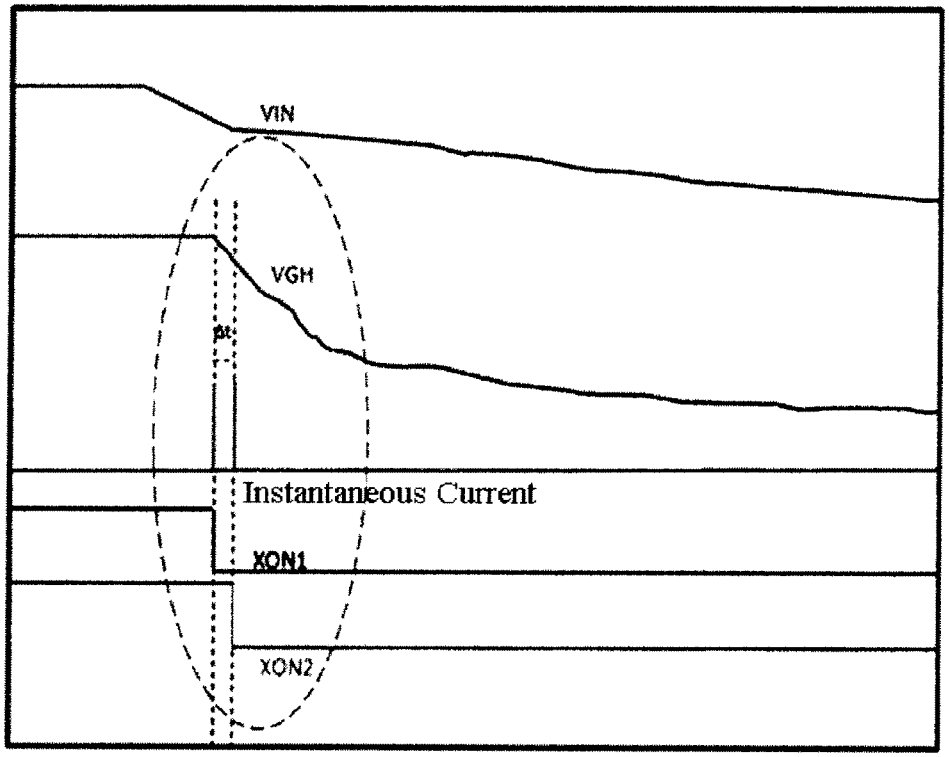
FIG. 7*a* and FIG. 7*b* are waveform diagrams illustrating an input voltage and an output voltage of a circuit according to the embodiments of the invention when the display shuts down.
Figure 7B:
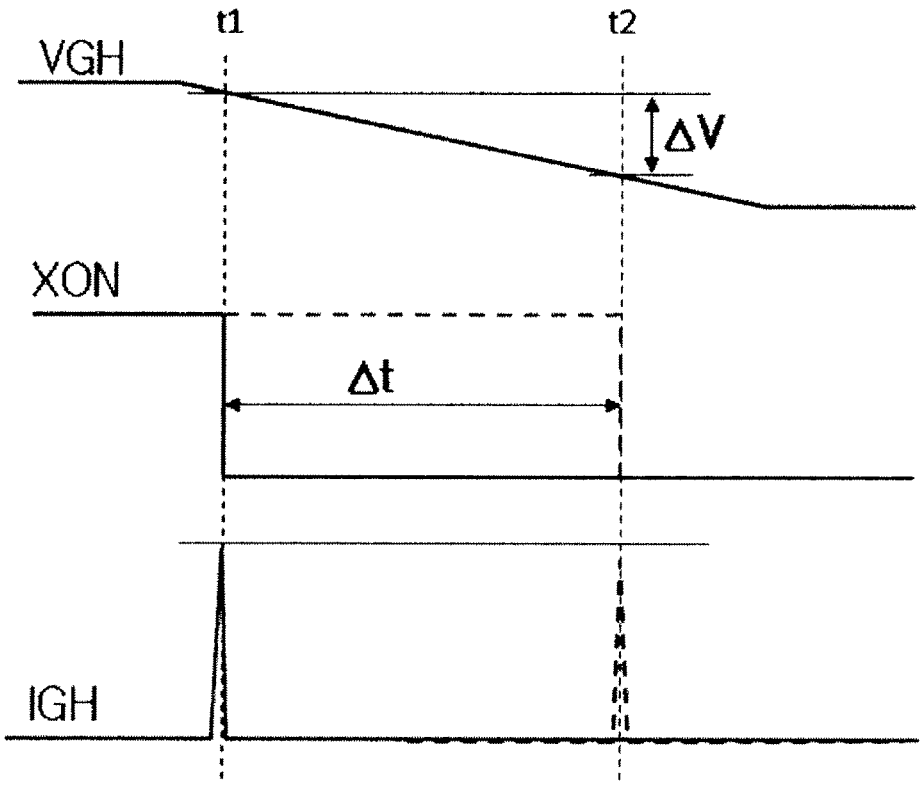

As illustrated in FIG. 4, when the circuit according to the present embodiment is used, the output terminals XON1 and XON2 are connected, respectively, with different TFTs on the liquid crystal display panel so that the purpose of triggering different TFTs to turn on at different moments is achieved when the display shuts down. The time division circuit designed in the present disclosure may be utilized to realize an area-division control for the display screen panel to enable that the output voltage enters different areas in a time-division mode and the TFTs in the different areas are turned on sequentially, which reduces the great instantaneous current generated at the moment of shutdown and achieve an effect of preventing wirings on the panel from being burned out. FIG. 6 is a waveform diagram illustrating an input voltage and an output voltage of a circuit for eliminating shutdown afterimages of a display without the time division control in the prior art, and FIG. 7*a* and FIG. 7*b* are waveform diagrams illustrating the input voltage and the output voltage of the circuit according to the embodiments of the present invention when the display shuts down. In the FIG. 7*b*, t1 and t2 are moments when XON1 and XON2 output the high level, respectively. As can be seen from a comparison between FIG. 6 and FIG. 7*a*, FIG. 7*b*, the instantaneous current at the moment of shutdown can be reduced by applying the present invention.

Second Embodiment

Figure 5:
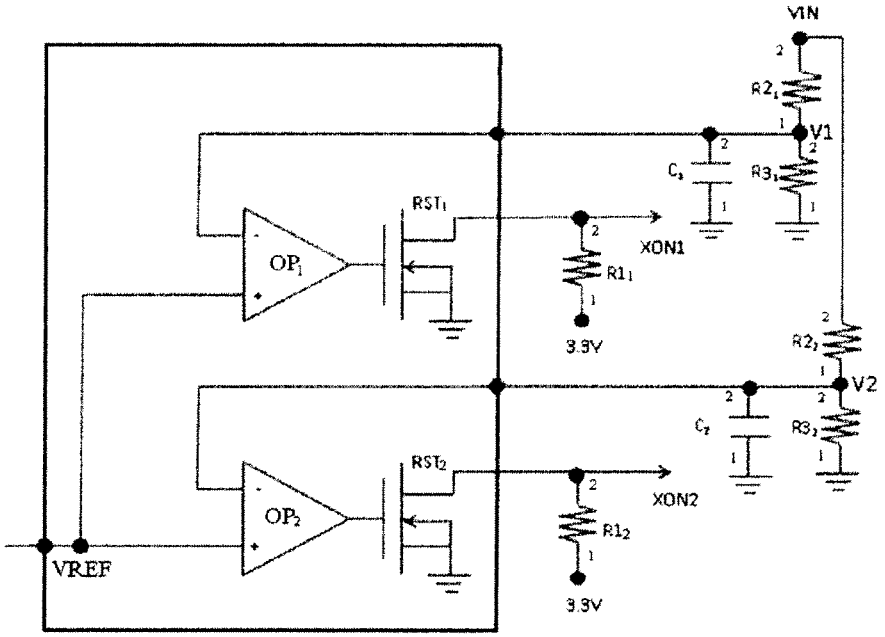
FIG. 5 is a circuit diagram illustrating a second embodiment of the invention.

As illustrated in FIG. 5, differences between the second embodiment and the first embodiment are in that, in the two stages of the time division circuits, the inverting terminal of the comparator are connected with the second terminal of the capacitor and the second terminal of the third resistor, the non-inverting terminal thereof is connected with the reference voltage, and all the MOS transistors are N-type MOSFET. The N-type MOSFET transistor is turned off when its gate is at the low level, then its drain outputs the high level (for example, 3.3V), and it is turned on when its gate is in the high level, then its drain outputs the low level (for example, 0V). The operation principle of the present embodiment is the same as that of the first embodiment.

As can be seen from the embodiments described above, by designing a circuit capable of generating voltages for tuning on TFTs in a time-division way, the invention realizes that when the display screen shuts down, not only the significant discontinuous differences of pictures are ensured to be not perceived by human eyes so as to eliminate the shutdown afterimages, but also such a problem is avoided that the circuitry in the panel is burned out by the overlarge instantaneous current caused by the simultaneous turning on of all the TFTs at the moment of shutdown. Furthermore, the time division circuit designed in the present disclosure may be utilized to realize an area-division control for the display screen panel.

The above are only exemplary embodiments of the invention. It should be noted that several modifications or replacements may be made by those skilled in the art without departing from the technical principle of the invention. These modifications or replacements are intended to be included within the scope of the present invention.

The invention claimed is:

1. A circuit for eliminating shutdown afterimages of a display, including a plurality of stages of time division circuits, the time division circuit in each stage comprises: a comparator, a MOS transistor, a first resistor, a second resistor, a third resistor and a capacitor, wherein a first terminal of the first resister serves as a first input terminal of the time division circuit of the stage, and a second terminal thereof serves as an output terminal of the time division circuit of the stage; a first terminal of the second resistor is connected with a second terminal of the third resistor, a second terminal of the second resistor serves as a second input terminal of the time division circuit of the stage, and a first terminal of the third resistor is grounded; an non-inverting terminal or an inverting terminal of the comparator is connected with a second terminal of the capacitor and the second terminal of the third resistor, the inverting terminal or the non-inverting terminal of the comparator is connected with a reference voltage of the time division circuit of the stage, an output terminal of the comparator is connected with a gate of the MOS transistor, a drain of the MOS transistor is connected with the second terminal of the first resistor; a first terminal of the capacitor is grounded; and the inverting terminals of the comparators of the time division circuits in each stage are connected with each other, the non-inverting terminals are also connected with each other, and the first input terminals of the time division circuits in each stage are shared, and the second input terminals of the time division circuits in each stage are also shared.

2. The circuit of claim 1, wherein for the time division circuit in each stage, the non-inverting terminal of the comparator is connected with the second terminal of the capacitor and the second terminal of the third resistor when the MOS transistor is a P-type MOSFET transistor; and the inverting terminal of the comparator is connected with the second terminal of the capacitor and the second terminal of the third resistor when the MOS transistor is a N-type MOSFET transistor.

3. The circuit of claim 2, wherein for each stage of the time division circuits, both of a source and a substrate of the MOSFET transistor are grounded.

4. The circuit of claim 1, wherein, for the time division circuit in each stage, a fixed preset voltage is input to the first input terminal, and voltages being varied from high to low are input to the second input terminal.

5. The circuit of claim 4, wherein the second resistor and the third resistor satisfy the following relation:

$$R3_i/(R2_i+R3_i)*V_i=VREF,$$

wherein $R2_i$ represents the second resistor of the time division circuit of the $i^{th}$ stage, $R3_i$ represents the third resistor of the time division circuit of the $i^{th}$ stage, VREF represents the reference voltage of the time division circuit of the $i^{th}$ stage, $V_i$ is a preset value, and i is a positive integer and greater than 1.

6. The circuit of claim 5, wherein when there are two stages of the time division circuits, $V_1$ is 4.0V, $V_2$ is 3.7V, and a voltage inputted to the first input terminal is 3.3V.

7. The circuit of claim 6, wherein for each stage of the time division circuits, both of a source and a substrate of the MOSFET transistor are grounded.

8. The circuit of claim 5, wherein for each stage of the time division circuits, both of a source and a substrate of the MOSFET transistor are grounded.

9. The circuit of claim 4, wherein a voltage at the second input terminal satisfies the following condition:

$$VIN>Vi>V(i-1)>\ldots>V1>VREF$$

wherein VIN represents the voltage at the second input terminal, VREF represents the reference voltage of the time division circuit of the $i^{th}$ stage, Vi represents a voltage at a node between the second resistor and the third resistor of the time division circuit of the $i^{th}$ stage, and i is a positive integer and greater than 1.

10. The circuit of claim 9, wherein for each stage of the time division circuits, both of a source and a substrate of the MOSFET transistor are grounded.

11. The circuit of claim 4, wherein a delay time Δt for outputting a high level from the output terminal XONi of the time division circuit of the $i^{th}$ stage with respect to the output terminal XON(i−1) of the time division circuit of the $(i-1)^{th}$ stage satisfies three conditions as follows simultaneously:

I. Δt is less than a period of time when VIN remains higher than the voltage at the first input terminal after XON(i−1) outputs the high level;

II. Δt is more than duration of an instantaneous current generated when the display shuts down for the first time;

III. Δt<33.3 ms;

wherein VIN represents the voltage at the second input terminal.

12. The circuit of claim 11, wherein 100 μs<Δt<5 ms.

13. The circuit of claim 12, wherein for each stage of the time division circuits, both of a source and a substrate of the MOSFET transistor are grounded.

14. The circuit of claim 11, wherein for each stage of the time division circuits, both of a source and a substrate of the MOSFET transistor are grounded.

15. The circuit of claim 4, wherein for each stage of the time division circuits, both of a source and a substrate of the MOSFET transistor are grounded.

16. The circuit of claim 1, wherein for each stage of the time division circuits, both of a source and a substrate of the MOSFET transistor are grounded.

* * * * *